US007664435B2

(12) United States Patent
Nose

(10) Patent No.: US 7,664,435 B2
(45) Date of Patent: Feb. 16, 2010

(54) DEVELOPMENT APPARATUS

(75) Inventor: Katsuya Nose, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 386 days.

(21) Appl. No.: 11/677,218

(22) Filed: Feb. 21, 2007

(65) Prior Publication Data

US 2007/0231011 A1 Oct. 4, 2007

(30) Foreign Application Priority Data

Mar. 30, 2006 (JP) ..... 2006-093254

(51) Int. Cl.
*G03G 15/01* (2006.01)

(52) U.S. Cl. ..... 399/227; 399/224; 399/258

(58) Field of Classification Search ..... 399/224, 399/227, 256, 258, 262, 263
See application file for complete search history.

(56) References Cited

U.S. PATENT DOCUMENTS 4,622,916 A * 11/1986 Tanaka et al. ..... 118/688
6,291,123 B1 * 9/2001 Ohno et al. ..... 430/111.4
6,542,707 B2 * 4/2003 Muramatsu et al. ..... 399/258
2003/0198484 A1 * 10/2003 Chigono et al. ..... 399/175

FOREIGN PATENT DOCUMENTS

JP 63177171 A * 7/1988
JP 5-224530 9/1993

* cited by examiner

*Primary Examiner*—David M Gray
*Assistant Examiner*—Benjamin Schmitt
(74) *Attorney, Agent, or Firm*—Fitzpatrick, Cella, Harper & Scinto

(57) ABSTRACT

There is provided a development apparatus including a plurality of replenishment developer containers which accommodates a replenishment developer containing a toner to be replenished to a plurality of development devices, a plurality of replenishment developer conveyance paths which replenishes the replenishment developer in the plurality of replenishment developer containers to the plurality of development devices, a plurality of conveyance members provided in the plurality of replenishment developer conveyance paths, wherein a length of at least one conveyance path, of the plurality of replenishment developer conveyance paths, is different from that of other conveyance paths, and cohesion degree of a replenishment developer conveyed by the longest conveyance path, of the plurality of replenishment conveyance paths, is lower than cohesion degree of the replenishment developer conveyed by other conveyance paths.

5 Claims, 6 Drawing Sheets

FIG. 4

TABLE 1

| NUMBER OF COHESION CLUSTERS | 1 PIECE/1 g | 5 PIECES/1 g | 10 PIECES/1 g |
|---|---|---|---|
| NUMBER OF STAIN OCCURRENCE | NONE | 1 PIECE | 5 PIECES |

TABLE 2

| TONER COHESION DEGREE | COHESION DEGREE 30 | COHESION DEGREE 50 | COHESION DEGREE 70 |
|---|---|---|---|
| NUMBER OF COHESION CLUSTERS | 0 PIECE | 1 TO 2 PIECES | MORE THAN 10 PIECES |

TABLE 3

| PLACE OF COHESION CLUSTER GENERATION | WITHIN CARTRIDGE | WITHIN HOPPER | HOPPER REPLENISHMENT SCREW | ROTARY REPLENISHMENT SCREW |
|---|---|---|---|---|
| NUMBER OF COHESION CLUSTERS | 1 TO 2 PIECES | 1 TO 2 PIECES | 3 TO 4 PIECES | 3 TO 4 PIECES |

*FIG. 5*

TABLE 4

| SCREW LENGTH | LM SCREW | C SCREW | M SCREW |
|---|---|---|---|
| NUMBER OF COHESION CLUSTERS | 7 TO 8 PIECES | 3 TO 4 PIECES | 1 TO 2 PIECES |

TABLE 5

| | LM | K | LC | C | Y | M |
|---|---|---|---|---|---|---|
| SCREW LENGTH | 30cm | 25cm | 20cm | 15cm | 10cm | 5cm |
| COHESION DEGREE | 40% | 45% | 50% | 50% | 50% | 50% |
| NUMBER OF COHESION CLUSTERS | 4 TO 5 PIECES | 4 TO 5 PIECES | 4 TO 5 PIECES | 3 TO 4 PIECES | 2 TO 3 PIECES | 1 TO 2 PIECES |
| NUMBER OF STAINS OCCURRED | NONE | NONE | NONE | NONE | NONE | NONE |
| TONER PARTICLE DIAMETER | 7$\mu$m | 5.5$\mu$m | 7$\mu$m | 5.5$\mu$m | 5.5$\mu$m | 5.5$\mu$m |
| AMOUNT OF $SiO_2$ ADDED | 4% | 5% | 4% | 5% | 4% | 5% |

FIG. 6

TABLE6

| COHESION DEGREE OF TONER | COHESION DEGREE 30 | COHESION DEGREE 50 | COHESION DEGREE 70 |
|---|---|---|---|
| NUMBER OF COHESION CLUSTERS FOR REPLENISHMENT DEVELOPER WITH TONER ONLY | 0 PIECE | 1 TO 2 PIECES | MORE THAN 10 PIECES |
| NUMBER OF COHESION CLUSTERS FOR MIXED REPLENISHMENT DEVELOPER WITH TONER AND CARRIER | 0 PIECE | 2 TO 3 PIECES | MORE THAN 15 PIECES |

TABLE 7

| | LM | K | LC | C | Y | M |
|---|---|---|---|---|---|---|
| SCREW LENGTH | 30cm | 25cm | 20cm | 15cm | 10cm | 5cm |
| COHESION DEGREE | 35% | 40% | 45% | 50% | 50% | 50% |
| NUMBER OF COHESION CLUSTERS | 4 TO 5 PIECES | 4 TO 5 PIECES | 4 TO 5 PIECES | 4 TO 5 PIECES | 3 TO 4 PIECES | 2 TO 3 PIECES |
| NUMBER OF STAINS OCCURRED | NONE | NONE | NONE | NONE | NONE | NONE |
| TONER PARTICLE DIAMETER | 7$\mu$m | 5.5$\mu$m | 7$\mu$m | 5.5$\mu$m | 5.5$\mu$m | 5.5$\mu$m |
| AMOUNT OF $SiO_2$ ADDED | 5% | 5.5% | 4.5% | 5% | 4% | 5% |

DEVELOPMENT APPARATUS

BACKGROUND OF THE INVENTION

1. Field of the Invention

The present invention relates to a development apparatus of an electrophotographic image forming apparatus of an electrophotographic type, such as copying machine, laser beam printer, facsimile and complex machine (hereafter referred simply to as an "image forming apparatus").

2. Related Background Art

In an image forming apparatus of an electrophotographic type or electrostatic recording type, a latent image is formed on a electrostatic latent image bearing member, for example, a photosensitive drum, and a visible image is obtained by attaching a developer (toner) to this latent image. Particularly, in a color image forming apparatus for forming chromatic color images, a development method using a two-component developer including a toner and a carrier is used widely since stability of image quality and durability of the apparatus are superior to those of other development methods.

In the development method using a two-component developer, including a nonmagnetic one component toner and a magnetic carrier (hereafter referred simply to as "toner and carrier") being charged in the development apparatus, toner alone is being consumed for development of electrostatic latent image. Therefore, toners should be replenished freshly one-by-one to the development apparatus for each of the colors. In order to maintain an electrostatic latent image at a predetermined development concentration at all times, an amount of the toner to be replenished should be controlled strictly. For example, when the toner is replenished from toner cartridges corresponding to each of Y, M, C and K colors to the development apparatus, generally, those with such a structure that the toner is fed in a pushing manner by rotating a powder conveyance screw having a spiral structure which is provided for every color, and the conveyance amount is controlled, have been frequently used. Reasons why the powder conveyance screw is frequently used are that the conveyance amount per one rotation of the screw can be determined easily with a simple structure thereof and that necessary controls can be accomplished with reduced costs.

In recent years, it has been requested that images with various image ratios, from large images having a large image area, such as photographs, to small images having a small image area, such as one-point-color, should be output at high speed and with stable manner. In this case, use of above-mentioned powder conveyance screw for toner replenishment (hereafter referred to as "toner conveyance screw") involves the following problems:

As for the toner conveyance screw, a screw shaft equipped with a blade in a spiral form penetrates through a screw pipe and is rotated to feed the toner in a pushing manner by the spiral blade in the pipe. A minimal allowance clearance is provided between an outside diameter of the spiral blade and an inside diameter of the screw pipe so as to enable rotation of the spiral blade. In some cases, a so-called "flashing phenomenon" in which the toner leaks out from such clearance and is supplied more than necessary to the development apparatus, is generated, thereby posing a problem. In order to solve this flashing phenomenon problem, a toner replenishment apparatus which regulates a toner amount by adjusting the clearance is proposed (see, for example, Patent Document 1).

[Patent Document 1] Japanese Patent Application Laid-Open No. 5-224530

However, even when a toner amount is regulated by adjusting the clearance as is the case of the toner replenishment apparatus disclosed in the patent publication of above-mentioned Patent Document 1, there still remain unresolved problems.

In recent years, from the viewpoints of higher image quality, energy saving and speeding up of copying operation, there has been a tendency towards use of a toner having smaller diameter particles and a lower melting point. Therefore, toners with a higher degree of cohesive force (or sticking power) which is one of factors for determining the powder fluidity, namely, higher cohesion degree toners, have been frequently used. Therefore, when runout or eccentricity is caused to the toner conveyance screw while rotating, toner is ground in the clearance with regard to the screw pipe, thereby generating toner cohesion clusters. These toner cohesion clusters result in defective images, such as a void image or a stain on the image. Particularly, with copying machines in which a toner conveyance screw is used frequently to replenish toner from a toner cartridge to a development apparatus, suppression of generation of cohesion cluster as mentioned poses a significant problem.

In addition, as a known development method in color image forming apparatus, a rotary-type development unit is mentioned. For example, this method has such a configuration that a plurality of development apparatuses corresponding to each of Y, M, C, K are equally distributed on the same circumference in a radial pattern and are displaced in a rotational manner and are rotated to a position facing an electrophotographic photosensitive drum (hereafter referred simply to as a "photosensitive drum") that is a latent image bearing member to initiate development. In this case, for example, cartridges to which each color of Y, M, C, K toner are charged are arranged in one row in a tandem manner and are provided at upper portion of a rotary-type development unit to increase the amount of toner accommodation as much as possible.

In this case, each of the development apparatuses corresponding to Y, M, C, K arranged in a radial manner in the rotary-type development unit which is a rotating body is connected through a toner replenishment path to each of those corresponding to a plurality of cartridges arranged in one row at an upper portion thereof. Therefore, it is natural from geometrical viewpoints that there is a dimensional difference between each length of the replenishment path corresponding to Y, M, C, and K. Thus, a toner conveyance screw is arranged to each of toner replenishment paths having dimensional differences to form a part of the replenishment path, and therefore, a length of the screw shaft and a length of the screw pipe are also different for Y, M, C, and K. If the length of toner conveyance screw is different for Y, M, C, K, there is also a difference of the time for the toner to pass through the screw pipe resulting in a difference of generation of toner cohesion clusters. In other words, replenishing the toner of the same component uniformly from the toner cartridge to each of development apparatuses does not constitute a fundamental solution for suppression of the generation of toner cohesion clusters and for prevention of defective images due to a void image or a stain on the image.

SUMMARY OF THE INVENTION

An object of the present invention is to provide a development apparatus capable of obtaining a stable image by suppressing effectively the generation of cohesion clusters of the toner thereby preventing occurrence of defective images.

A development apparatus to accomplish the above-mentioned object comprises:

a plurality of development devices which develops an electrostatic image;

a plurality of replenishment developer containers each of which accommodates a replenishment developer containing a toner to be replenished to each of the plurality of development devices;

a plurality of replenishment developer conveyance paths which communicates the plurality of replenishment developer containers with the plurality of development devices, and which replenishes the replenishment developer in the plurality of replenishment developer containers to each of the plurality of development devices; and a plurality of conveyance members which are provided in each of the plurality of replenishment developer conveyance paths for conveying the replenishment developer;

wherein a length of at least one conveyance path, of the plurality of replenishment developer conveyance paths, is different from that of other conveyance paths, and cohesion degree of replenishment developer to be conveyed by a longest conveyance path, of the plurality of replenishment developer conveyance paths, is lower than cohesion degree of replenishment developer to be conveyed by other conveyance path

BRIEF DESCRIPTION OF THE DRAWINGS

FIG. 4 shows Table 1, Table 2, Table 3 in which measurements in the first embodiment are summarized.

FIG. 5 shows Table 4, Table 5 in which measurements in the first embodiment are summarized.

FIG. 6 shows Table 6, Table 7 in which measurements in a second embodiment of the invention are summarized.

DETAILED DESCRIPTION OF THE EMBODIMENTS

Now, referring to drawings, each one exemplary embodiment of the development unit and the image forming apparatus according to the present embodiment is described in detail hereafter.

Figure 1:
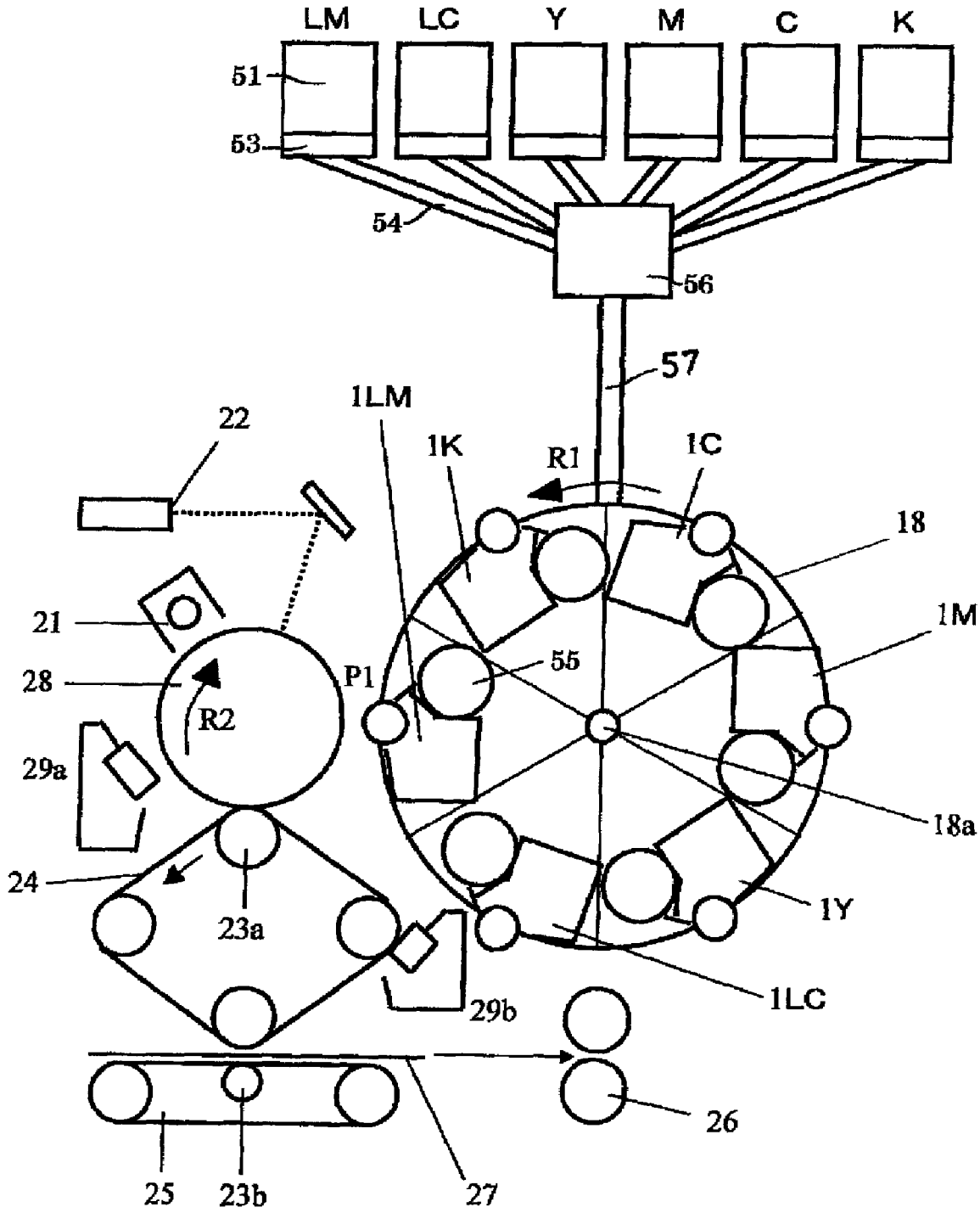
FIG. 1 is a drawing illustrating a part of an image forming apparatus equipped with a development unit according to a first embodiment of the invention.

FIG. 1 illustrates an image forming apparatus having a rotary-type development apparatus 18 which has cylindrical form and is rotatable (hereafter referred simply to as a "development unit"). On the circumference about a rotating shaft 18*a* of the development unit 18, for example, development devices 1Y, 1M, 1C and 1K corresponding to each color of Y (yellow), M (magenta), C (cyan), K (black), development device 1LM for light magenta, development device 1LC for light cyan are equally distributed in a radial manner. Meanwhile, light magenta and light cyan are color having the same hue with regard to magenta and cyan, respectively, and low density (light color). By performing development with a combination of such a light color toner and deep color toner, the granularity of images can be improved. Hereafter, these are collectively named as a development device 1 except otherwise as necessary. The development unit 18 is rotated upon receiving rotational power from a motor (not shown) which serves as a rotational power source. As a result of the rotation, an arbitrary development device 1 is displaced to a proximity position for process action to a photosensitive drum 28 which is a latent image bearing member while the other development devices 1 are retreated from a photosensitive drum 28.

The image forming apparatus operates follows:

In FIG. 1, a primary charger 21 applies a charged bias voltage to charge the surface of the photosensitive drum 28 and forms an electrostatic latent image on the photosensitive drum 28 by an exposure unit, such as a laser scanner 22. The development apparatus 1 forms a toner image on the electrostatic latent image on the photosensitive drum 28, and this toner image is transferred on an intermediate transfer belt 24 by a first transfer bias by a first transfer charger 23*a*.

When a full color image is to be formed, for example, first, a toner image of light magenta is formed on the photosensitive drum 28 by a development apparatus 1LM for light magenta, and the light magenta toner image is then primary transferred on the intermediate transfer belt 24. Subsequently, a rotary-type development body 18 is displaced in rotational manner by an angle of 60° to bring the development apparatus 1LC for light cyan to a development position P1. A toner image of light cyan is formed on the photosensitive drum 28, and the toner image of light cyan is superimposed onto the toner image of light magenta mentioned above on the intermediate transfer belt 24 by way of primary transfer. Such operations are executed sequentially in the development apparatuses 1Y, 1M, 1C, 1K to form full color images based on chromatic toner onto the intermediate transfer belt 24.

Following this, by a second transfer bias by way of a second transfer charger 23*b*, images on the intermediate transfer body belt 24 are collectively secondary transferred onto a sheet 27 such as recording paper on a transfer paper conveyance belt 25, and the sheet 27 is released from the transfer paper conveyance belt 25. It is then fed to a fixing device 26 and fixed by pressurizing and heating to obtain a permanent image. Further, toner remaining on the photosensitive drum 28 after a primary transfer is removed by a first cleaner 29*a*, and toner remaining on the intermediate transfer belt 24 after a secondary transfer is removed by a second cleaner 29*b*, to be in stand-by state for the next image forming operation.

Figure 2:
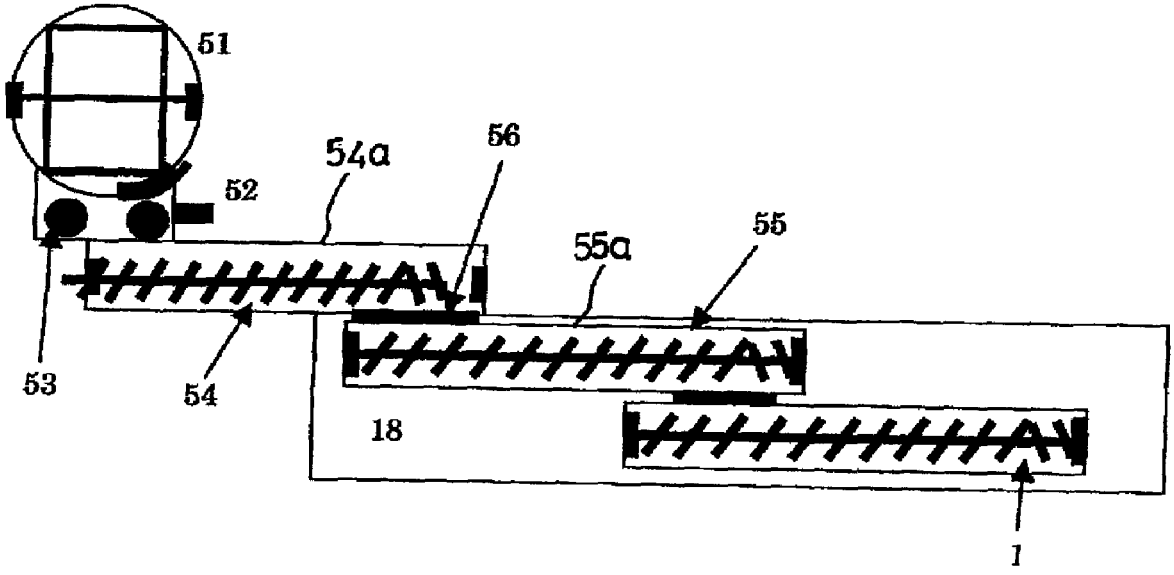
FIG. 2 is a drawing illustrating a toner replenishment path for every color from a toner cartridge which is a main part in the development unit according to the present embodiment, to a rotary-type development unit.

Referring to FIGS. 1 and 2, the conveyance path for conveying the toner by the replenishment developer conveyance path from a toner cartridge (replenishment developer container) 51, in which toner of each color LM, LC, Y, M, C, K is charged, to the rotary-type development unit 18 will be described.

At an upper portion of the development unit 18, large capacity toner cartridges 51 are arranged in single horizontal row in tandem manner in the order of, for example, an image forming operation performed by each color LM, LC, Y, M, C, K. Besides, a hopper 53 for replenishing the toner to each development apparatus 1 is provided for each toner cartridge 51, and a piezo-sensor 52 for detecting the toner is provided inside of each hopper. When output of a toner detection signal from the piezo-sensor 52 is ceased, a control is made so that the toner is fed from the toner cartridge 51 to the hopper 53. The toner in the hopper 53 is supplied to the development unit 18 by rotational driving force of a hopper replenishment screw (conveyance member) 54 in a pushing manner. In other words, the hopper replenishment screw 54 has a screw shaft onto which a blade is formed in a spiral form, a rotational speed (revolution: rpm) of the shaft is controlled by an automatic toner replenishment apparatus (ATR), and the toner is replenished to the target development unit 18 while rotating at a desired rotational speed.

As shown in FIG. 2, the toner being fed from the hopper replenishment screw 54 in a pushing manner is delivered to a rotary replenishment screw (conveyance member) 55 corresponding to each development device 1 in the development unit 18. The toner is replenished thoroughly to each development device 1 by the rotary replenishment screw 55 thereof. In this way, the replenishment developer conveyance path communicates the developer replenishment container 51 with the development device 1, provided with conveyance members (54, 55) therein, and serves as the replenishment route (54*a*, 55*a*) for replenishment of the replenishment developer in the developer replenishment container to the development device 1. Meanwhile, a length of the replenishment conveyance path corresponds to a length of the replenishment route (54*a*, 55*a*).

As for a toner replenishment method for the above-mentioned case, it is possible to employ a video counting type ATR which predicts toner consumption by measuring laser exposure time. As for performance of a toner replenishment of this type, replenishment accuracy represented by variation of amount of replenishment per unit number of times of replenishment or by unit time affects image density and particularly affects tint stability. For this reason, an encoder is disposed at the most upperstream side of the hopper replenishment screw 54, and rotational speed of the hopper replenishment screw 54 is controlled based on the signal from this encoder.

The amount of toner replenishment obtained when the hopper replenishment screw 54 is rotated one time is defined to be "One replenishment unit". When replenishment time is controlled by the above-mentioned toner replenishment method, a variation of the replenishment amount expressed by the one replenishment unit can be reduced to approximately 1/10 of variation of the replenishment amount by conventional method. To attain this level, it is necessary to charge an equal amount of replenishment toner all the time to every screw pitch of the hopper replenishment screw 54. In addition, the replenishment toner should be charged while inside of the screw pipe 54*a*, through which screw shaft of the hopper replenishment screw 54 penetrates, is sealed reasonably all the time. In the meantime, with an allowable tolerance clearance provided between an outside diameter of the spiral blade of the screw shaft of the hopper replenishment screw 54 and an inside diameter of the screw pipe 54*a*, it has been reported that rubbing and grinding of the replenishment toner occur. On the other hand, the replenishment toner fed from the rotary replenishment screw 55 to the development unit 18 is being fed entirely to the development apparatus 1 at the time of replenishment. Therefore, rubbing and grinding of the replenishment toner at the clearance between an outside diameter of the spiral blade of the rotary replenishment screw 55 and an inside diameter of the screw pipe 55*a* occur very rarely.

Next, toner cohesion clusters which may cause defective images due to a void image or a stain on the image are generated by rubbing with inner circumference of the screw pipes 54*a*, 55*a*, or generated by electrostatic cohesion of toner particles themselves. In general, when rubbing time is long, defective images are caused more easily under low-humidity environments than high-humidity environments. As for the size of cohesion clusters, cohesion clusters more than 1 mm in diameter are present while a particle diameter of ordinary toner is 5.5 μm. If these cohesion clusters are replenished to inside the development unit 18, although majority of clusters can be crushed by the rotary replenishment screw 55, larger particles or cohesion clusters with higher cohesiveness cannot be crushed, but are subject to development. As a result, images with a drip-drop stain appear as defective images. If it is extremely difficult to eliminate cohesion clusters thoroughly, an allowable extent of generation of the cohesion clusters will be analyzed hereafter based on the measurements.

Measurement of Cohesion Degree

As one of the methods to know the degree of cohesion, flow characteristics of a sample representing the replenishment developer are measured. The basis of determination is such that the greater the cohesion degree is, the more likely the sample has "Defective fluidity" as the replenishment developer. The sample as the replenishment developer denotes in some cases a single body including non-magnetic toner alone, or an admixture of non-magnetic toner and magnetic carrier, or in another case, toner containing an external additive. The external additive is a fine powder and is used as the toner surface modifier, and in recent years, it is used, in some cases, as the image density improving agent. The object of cohesion degree in the present invention is a state as the toner containing the additive. With a developer in which a magnetic carrier and a non-magnetic toner are mixed, measurement of the cohesion degree is performed for the non-magnetic toner excluding the magnetic carrier.

Embodiment 1

Powder tester (Hosokawa Micron Corporation) equipped with digital vibration meter (Digivibro Model 1332) was used as the measuring device. On the vibration stand sieves having a 380 mesh, a 200 mesh, a 100 mesh in the named order of finer mesh were laminated so that the 100 mesh sieve may be positioned uppermost. 5 g of precisely weighed sample was added on the 100 mesh sieve thus set, displacement of the digital vibration meter was set to 0.5 mm (peak-to-peak), and vibrations were exerted for 15 sec. After that, weight of the sample left on each of sieves was measured and measurement was substituted in Equation (1) shown below to calculate cohesion degree. Samples used were left under a 23° C./60% RH environment for about 12 hours.

$$\text{Cohesion degree (\%)} = (\text{Weight of sample on 100 mesh sieve}/5\text{ g}) \times 100 \times (1/1) + (\text{Weight of sample on 200 mesh sieve}/5\text{ g}) \times 100 \times (3/5) + (\text{Weight of sample on 380 mesh sieve}/5\text{ g}) \times 100 \times (1/5) \quad (1)$$

Measurement of Cohesion Clusters in Replenishment Developer Sample

The number of cohesion clusters is measured to know the number of cohesion clusters, which result in defective images such as a void image or a stain in the sample image.

First, a sieve having 75 μm openings was set on the vibration stand, 1 g (gram) of precisely weighed sample toner was added onto this mesh sieve, an amplitude of vibration was adjusted to 5 mm, and vibrations were exerted 800 cycles in 30 sec. Following this, the number of cohesion clusters left on the mesh sieve was counted. This measurement was repeated 10 times and the number of cohesion clusters (sampling average) was calculated.

In the meantime, in order to know a possible correlation between the number of such clusters, and defects and imperfections on the image, cohesion clusters collected at actual measurement are mixed directly into the development apparatus, 20 sheets of halftone images were output, and the number of stains appeared on the images was actually measured. In this case, cohesion cluster(s) of about 1 mm in size were mixed 1 piece, 5 pieces, 10 pieces with regard to toner replenishment amount of 1 g. Results of the measurements are normalized with respect to the number of pieces of cohesion clusters present in 1 g of the sample toner and are shown in Table 1.

Table 2 through Table 7 described herein as well as Table 1 mentioned above are shown in the separate sheets.

The material used as the sample of replenishment developer was prepared such that resin binders made primarily of polyester were kneaded together with wax and pigments, which were then crushed and classified to obtain ones having an average volumetric particle diameter of around 5.5 μm. After that, appropriate amounts of additives were added to yield cyan toner having a 50% cohesion degree to be used for assessment. It is understood from measurement results shown in Table 1 that the number of cohesion clusters to be mixed in the development apparatus 1 should be less than 5 pieces.

Next, in order to know a toner cohesion degree at which cohesion clusters are generated, using toners with cohesion degrees of 30%, 50%, 70% (this difference of cohesion degrees was generated by changing amount of the additives appropriately), the number of cohesion clusters under room temperature/low-humidity environments (23° C./5%) was measured. For assessment, sample toner to be used as the assessment object was charged in the cartridge, and the number of cohesion clusters in the cartridge was used as the basis of assessment. Results of assessment are shown in Table 2.

It is understood from assessment results shown in Table 2 that samples with a higher cohesion degree tend to easily generate cohesion clusters. Therefore, it is possible to suppress generation of cohesion clusters effectively, if toner with cohesion degree less than 30% is used as a replenishment developer. However, when toner with a lower cohesion degree (less than 30%) is used as the replenishment developer, defective images such as varied transfer at the primary transfer portion due to high fluidity occur and changes in a sealed state in the screw pipe 54*a* of the hopper replenishment screw 54 become excessive, which easily results in variation of the amount of replenishment. On the other hand, when toner with a higher cohesion degree (more than 70%) as the replenishment developer is used, defective images such as a white void due to reduction in development efficiency occur and toner transport efficiency in the screw pipe 54*a* is reduced remarkably.

In other words, toner as the optimum replenishment developer would be obtained if a toner cohesion degree is adjusted to 30% or more and 70% or less, preferably 40% or more and 60% or less. Meanwhile, there are several methods for adjustment of the cohesion degree of toners. First, adjustment by toner particle diameter is mentioned. In general, the greater the toner particle diameter is, the lower the cohesion degree is. Further, adjustment by the amount of an addition of external additives, for example, $SiO_2$, is available. In general, the greater the weight ratio with regard to the toner is, the lower the cohesion degree is. Furthermore the cohesion degree depends on materials of pigments added to the toner to develop toner color. Therefore, it is possible to obtain a desired particle diameter by combining these several factors. It goes without saying that, since alteration of the combination would affect image quality, good balance should be maintained with regard to the image quality. The method for changing the cohesion degree is not limited to those mentioned herein.

Meanwhile, in order to identify the place of cohesion cluster generation, the number of cohesion clusters generated was assessed at cyan (C) station in the image forming apparatus. Assessment results are shown in Table 3. It has been confirmed from these assessment results that generation of cohesion clusters is remarkable in the hopper replenishment screw 54 where a toner charging rate is the highest and an inner circumference of the screw pipe 54*a* is rubbed intensively. Further, as mentioned previously, since the number of cohesion clusters which permits occurrence of stains on the images in the image forming apparatus is less than 5 pieces, there is no possibility of the occurrence of defective images under this condition.

Meanwhile, an overall length of the hopper replenishment screw 54 (length of screw pipe 54*a*) acts as the factor for the difference of degree of generation of cohesion clusters. The primary object of the present invention is to resolve this problem.

As shown in FIG. 1, each of hopper replenishment screws 54 extending from each of toner cartridges 51 for LM, LC, Y, M, C, K arranged in one row in a tandem manner are gathered together at a screw assembly portion 56 to form one complete unit. One common replenishment pipe 57 from the screw assembly portion 56 goes down perpendicularly and is connected to one portion at the top of the development unit 18 which is a rotating body. The most downstream side outlet end of the common replenishment pipe 57 is connected to the rotary replenishment screw 55 of the development apparatus 1 which reached that position by rotational displacement. Thus, a "replenishment path" which serves as one replenishment route is formed.

Therefore, each of hopper replenishment screws 54 extending from each of toner cartridges 51 for LM, LC, Y, M, C, K are different in their length to the screw assembly portion 56. Namely, a length of the screw shaft and a length of the screw pipe 54*a* composing a part of the replenishment path for every color are different. In order to know how generation of cohesion clusters is affected by each of screw length, the following selection was made:

A screw for magenta which has the shortest length (for example, a screw pipe length 50 mm), a screw for cyan having intermediate length (for example, a screw pipe length 150 mm), a screw for light magenta having the longest length (for example a screw pipe length 300 mm) were selected. Cyan toner adjusted to have cohesion degree of 50 was charged to each of these screw pipes 54*a*, and the number of cohesion clusters generated in the toner was observed at the most downstream of the hopper replenishment screws 54 and then subjected to comparison investigation. Comparison results are shown in Table 4. It is known from the comparison results that the number of cohesion clusters generated is greatly associated with screw length.

Next, cyan toner with 50% cohesion degree was charged actually to all color stations and durability assessment of as many as 5,000 sheets was carried out for the sake of image assessment. It was then found that drip-drop stain was caused at stations for LC, K, LM which are longer than the screw length (150 mm) for cyan.

Taking these results into consideration, as Embodiment 1, toners (replenishment developer) with different cohesion degrees corresponding to the screw pipe length of the hopper replenishment screw 54 were supplied and investigation was made.

Table 5 shows relationships among characteristics of each toner (cohesion degree, toner particle diameter, amount of addition of $SiO_2$ (weight ratio of additives with regard to toner weight), length of screw pipe, number of cohesion clusters, and number of stain occurrences during durability assessment.

As it is seen from this table, in Embodiment 1 where length of a screw pipe of the hopper replenishment screw 54 is different for each color, light magenta toner (cohesion degree of 40%), which is adjusted so that the cohesion degree might become the lowest, was arranged for light magenta screw which had the longest screw pipe 54*a*. The particle diameter of light magenta toner was set to 7 μm, which was greater than particle diameter of magenta toner of 5.5 μm, to reduce a cohesion degree to be lower than that of magenta toner. Although the amount of addition of $SiO_2$ for magenta toner was greater, a lower cohesion degree was obtained since the factor of particle diameter was dominant. The difference in cohesion degree of the magenta toner from that of light cyan toner is attributable to the difference of pigments added to the toner. Besides, for K, LC toners which exceeded the allowable level of the number of cohesion clusters for stain occurrence, generation of toner cohesion clusters could be suppressed and defective images such as a void image or a stain on an image could be prevented by adjusting the cohesion degree of K, LC toners, appropriately.

Figure 3:
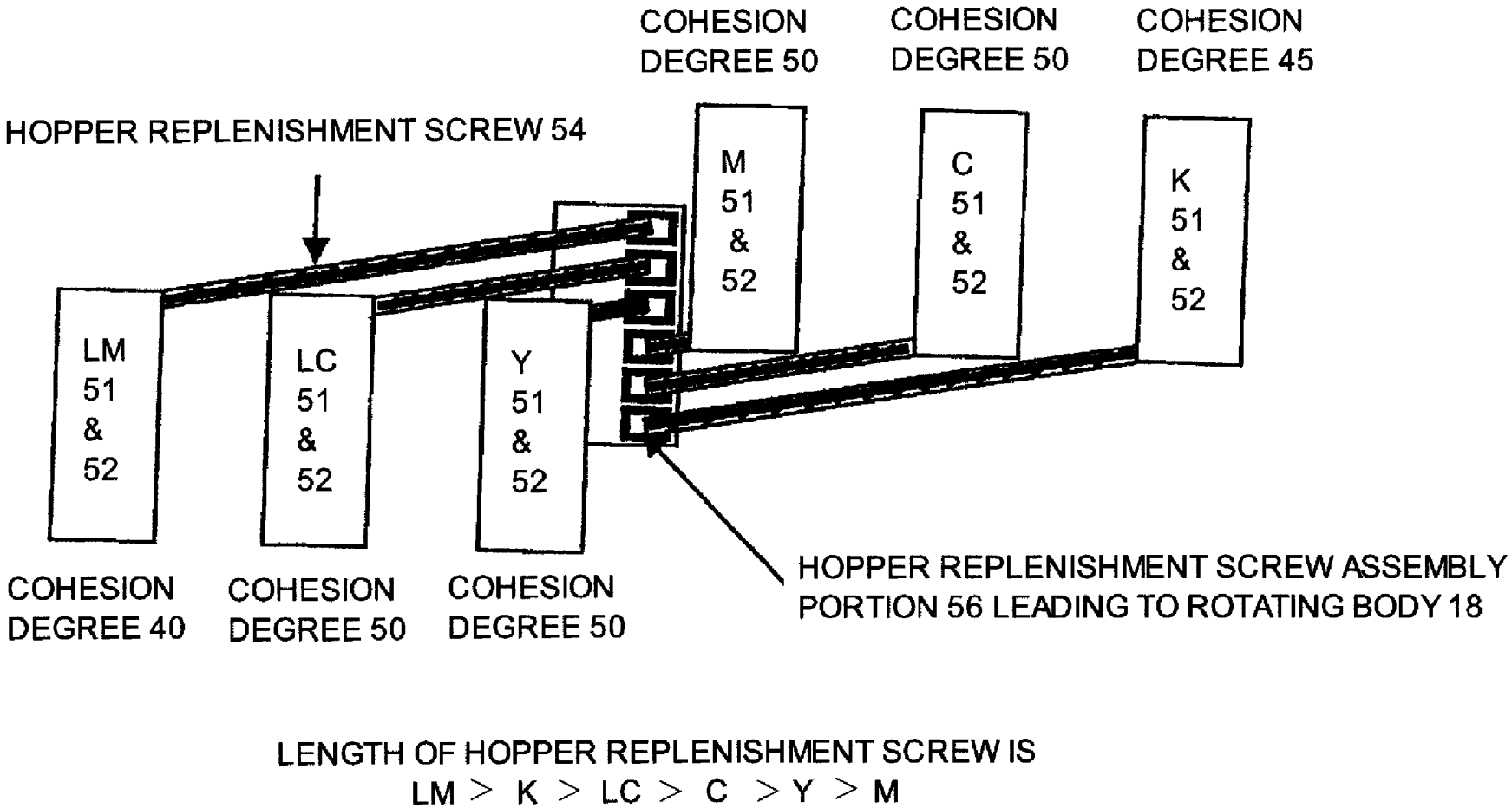
FIG. 3 is a drawing schematically illustrating replenishment of toners with preferred cohesion degree capable of preventing toner cohesion clusters corresponding to hopper replenishment screws having different length for each of colors.

FIG. 3 is a drawing schematically illustrating construction of exemplary Embodiment 1 for the development unit according to the present embodiment.

Embodiment 2

A development unit, in which replenishment developer (mixture of toner and a carrier) is charged to the toner cartridge 51, is frequently provided to an image forming apparatus. In this case, by replenishing a mixture of the toner and carrier, the carrier deteriorated from a durability viewpoint is replaced with a new carrier thereby lengthening toner service life.

When toner is solely used as the replenishment developer, and is compared to the replenishment developer based on mixing of the toner and carrier, since carriers having negative charge of the toner and toners attract each other by Coulomb attraction, electrostatic cohesion is easily caused, and cohesion clusters are easily generated. Then, for cases where a mixture of the toner and carrier is used, and where toner is solely used as the replenishment developer, the number of cohesion clusters generated was compared in relation to toner cohesion degree. Specifically, the number of cohesion clusters was measured using cyan toners with above-mentioned cohesion degrees of 30, 50, 70. Assessment toner, and mixture of assessment toner and carrier were charged in the cartridge for assessment, and the number of cohesion clusters in the cartridge was counted.

Assessment results are shown in Table 6. It was found from the assessment results that, in the case of replenishment developer based on mixing of the toner and carrier, the toner with higher cohesion degree generate cohesion clusters more remarkably than the case of replenishment developer including toner only. The fact that the place of cohesion cluster generation is the hopper replenishment screw 54 and that there is a tendency that a cohesion degree is fixed, the longer the screw length, the more cohesion clusters are generated, are identical for both cases; replenishment developer is based on mixing of the toner and carrier, and replenishment developer including toner only.

In Embodiment 2, similarly to above-mentioned Embodiment 1, an investigation was made by supplying a replenishment developer which is a mixture of a toner having different cohesion degrers depending on screw lengths of the toner replenishment screw 54 and a carrier. As a result, 4 pieces of cohesion clusters or more are generated at each of stations LM, K, LC. Durability assessment using 5,000 sheets was carried out, drip-drop stain occurs. Then, a further investigation was made using toners with lower cohesion degree prepared depending on a length of the screw. Table 7 shows relationships among toner of each color, screw length, number of cohesion clusters, and number of stain occurrence during durability assessment. In the present embodiment, these cohesion degrees were obtained by adjusting the added amount of $SiO_2$ with regard to Embodiment 1. As a result, it was found that in the case where replenishment developer is a mixture of the toner and carrier, a cohesion degree of the toner should be reduced much more than that necessary for the case where replenishment developer includes toner alone. From the above discussions, while a screw pipe length of the hopper replenishment screw 54 is different for each of colors, for light magenta screw having the longest screw pipe length, a mixture of light magenta including light magenta toner (cohesion degree 35%) which is adjusted to attain the minimal cohesion degree, and carrier was applied. For K and LC toners which exceeded the allowable level of the number of cohesion clusters for stain occurrence, generation of toner cohesion clusters could be suppressed and defective images, such as a void image or a stain on the image could be avoided by adjusting a cohesion degree appropriately.

Although the embodiment of the development unit according to the present invention is described as mentioned above by citing Embodiments 1, 2, it is to be understood that the present invention is not limited thereto, and covers other embodiments, modifications, variations and combination thereof as long as they come within the scope of the present invention. Further, although concrete examples of the measurements are shown as Embodiments 1, 2, the present invention is of course not represented by these measurements.

This application claims the benefit of priority from the prior Japanese Patent Application No. 2006-093254 filed on Mar. 30, 2006 the entire contents of which are incorporated by reference herein.

The invention claimed is:

1. A development apparatus comprising:

a plurality of development devices which develops an electrostatic image;

a plurality of replenishment developer containers each of which accommodates replenishment developer containing a toner to be replenished to each of the plurality of development devices;

a plurality of replenishment developer conveyance paths which communicates the plurality of replenishment developer containers with the plurality of development devices, and which replenishes the replenishment developer in the plurality of replenishment developer containers to each of the plurality of development devices; and a plurality of conveyance members which are provided in each of the plurality of replenishment developer conveyance paths for conveying the replenishment developer;

wherein a length of at least one conveyance path, of the plurality of replenishment developer conveyance paths, is different from that of the other conveyance paths of the plurality of replenishment developer conveyance paths, wherein a cohesion degree of replenishment developer to be conveyed by a longest conveyance path, of the plurality of replenishment developer conveyance paths, is lower than a cohesion degree of replenishment developer to be conveyed by the other conveyance paths of the plurality of replenishment developer conveyance paths, and wherein the replenishment developer includes a first replenishment developer containing toner and a carrier, and a second replenishment developer containing only toner, and a cohesion degree of the first replenishment developer is set to be lower than a cohesion degree of the second replenishment developer, when a length of a conveyance path of the first replenishment developer and a length of a conveyance path of the second replenishment developer are substantially equal.

2. The development apparatus according to claim 1, wherein a particle diameter of the replenishment developer to be conveyed by the longest conveyance path, of the plurality of replenishment developer conveyance paths, is larger than a particle diameter of the replenishment developer to be conveyed by the other conveyance paths of the plurality of replenishment developer conveyance paths.

3. The development apparatus according to claim 1, wherein the cohesion degree of the replenishment developer is 30% or more and 70% or less.

4. The development apparatus according to claim 1, wherein the cohesion degree of the replenishment developer is 40% or more and 60% or less.

5. The development apparatus according to claim 1, wherein each of the plurality of the conveyance members have screw profile, and an outside diameter of each of the plurality of conveyance members and an inside diameter of each of the plurality of replenishment developer conveyance paths are arranged so as to have a predetermined clearance.

* * * * *